US009039469B1

(12) United States Patent
Calamia et al.

(10) Patent No.: US 9,039,469 B1
(45) Date of Patent: May 26, 2015

(54) MOUNTING SYSTEM FOR A REAR STEERING ASSEMBLY OF A MARINE OUTBOARD ENGINE

(71) Applicant: BRP US INC., Sturtevant, WI (US)

(72) Inventors: Dave Calamia, Burlington, WI (US); Roger Raetzman, Pleasant Prairie, WI (US)

(73) Assignee: BRP US INC., Sturtevant, WI (US)

( * ) Notice: Subject to any disclaimer, the term of this patent is extended or adjusted under 35 U.S.C. 154(b) by 124 days.

(21) Appl. No.: 13/752,653

(22) Filed: Jan. 29, 2013

Related U.S. Application Data

(60) Provisional application No. 61/593,007, filed on Jan. 31, 2012.

(51) Int. Cl.
*B63H 20/08* (2006.01)
*B63H 21/36* (2006.01)
*B63H 20/02* (2006.01)

(52) U.S. Cl.
CPC ..... *B63H 20/02* (2013.01)

(58) Field of Classification Search
CPC ..... B63H 20/12; B63H 20/08; B63H 25/02; B63H 20/02; B63H 21/265; B63H 2020/003
USPC ..... 440/53, 61 R, 61 S, 61 F, 62, 63, 77
See application file for complete search history.

(56) References Cited

U.S. PATENT DOCUMENTS

| | | | | |
|---|---|---|---|---|
| 4,573,930 | A * | 3/1986 | Queen | 440/56 |
| 4,964,354 | A | 10/1990 | Latham | |
| 6,132,273 | A * | 10/2000 | Nakayama et al. | 440/77 |
| 6,669,517 | B1 * | 12/2003 | Alby et al. | 440/77 |
| 7,485,019 | B1 * | 2/2009 | Macier et al. | 440/76 |
| 8,147,283 | B2 * | 4/2012 | Furuya et al. | 440/63 |

OTHER PUBLICATIONS

Outboard Mounting Plates, [online]. Latham Marine, [retrieved on May 22, 2013]. Retrieved from the Internet: < URL: http://www.lathammarine.com/out-full-outboard-mounting-plates.htm.>.

* cited by examiner

*Primary Examiner* — S. Joseph Morano
*Assistant Examiner* — Anthony Wiest
(74) *Attorney, Agent, or Firm* — BCF LLP

(57) ABSTRACT

A marine outboard engine has a cowling having at least one rear panel at a rear end of the cowling. The cowling encloses a power head. A plurality of mount points are disposed inside the cowling and adapted for rigidly mounting a tie-bar bracket. Each mount point is rigidly connected to the power head and has a bracket-mounting hole formed therein. The at least one rear panel has defined thereon a visual indication of an area to be removed to create an opening adapted for receiving therethrough a tie-bar bracket mounted on and extending from the mount points. A tie-bar bracket having a mounting portion and a tie-bar coupling portion is also disclosed. A method of assembling the tie-bar bracket in the cowling is also disclosed.

30 Claims, 13 Drawing Sheets

MOUNTING SYSTEM FOR A REAR STEERING ASSEMBLY OF A MARINE OUTBOARD ENGINE

CROSS-REFERENCE

The present application claims priority to U.S. Provisional Patent Application No. 61/593,007, filed Jan. 31, 2012, the entirety of which is incorporated herein by reference.

FIELD OF THE INVENTION

The present invention relates to a mounting system for a rear steering assembly to be used in a marine outboard engine.

BACKGROUND

Many outboard engines are steered remotely from a watercraft's helm using a steering wheel, for example, and the user's steering input is transmitted to the steering assembly typically including a hydraulic actuator arrangement. The outboard engine is mounted on the transom of the watercraft and the actuator which actuates the outboard engine for steering is mounted on the swivel bracket connected to the transom and rotates the outboard engine around an axis of rotation of the swivel bracket.

It is sometimes desired to have multiple engines be connected to the watercraft. When two or more outboard engines are connected to a watercraft, the outboard engines are sometimes tied together by a tie-bar to synchronize the steering and for enabling both outboard engines to be steered using a single steering actuator. The tie-bar is typically pivotally connected via rod ends to the swivel bracket at a distance from its axis of rotation. The outboard engine is mounted to the swivel bracket via vibration isolation elements so that the vibrations of the engine are not transmitted to the watercraft. However, this introduces slack into the system due to the vibration isolation mounts connecting the swivel bracket to the engine which can reduce the precision and response of the steering system.

In racing and other high performance situations, it is known to attach steering brackets directly to the rear of the engine, thereby eliminating the slack caused by the swivel bracket's vibration isolation elements. However, such existing systems typically require disassembly of the engine's power head and/or significant alterations to the engine's cowling, both of which can seriously compromise the outboard engine's integrity.

Accordingly, there is a need for a steering mounting system which responds to the steering controls with less slack and more precision.

SUMMARY

It is an object of the present invention to ameliorate at least some of the inconveniences present in the prior art.

In one aspect, the present provides a marine outboard engine having a cowling having at least one rear panel at a rear end of the cowling. A power head is disposed inside the cowling. A plurality of mount points are disposed inside the cowling and adapted for rigidly mounting a tie-bar bracket, each mount point being rigidly connected to the power head and having a bracket-mounting hole formed therein. The bracket-mounting hole is one of a threaded hole and a through-hole. The at least one rear panel has defined thereon a visual indication of an area to be removed to create an opening adapted for receiving therethrough the tie-bar bracket mounted on and extending from the mount points.

In a further aspect, the bracket-mounting holes are disposed on the power head.

In yet another aspect, the marine outboard engine also has an engine block adapter disposed inside the cowling below the power head and rigidly connected to the power head. The mount points are disposed on the engine adapter block. The bracket-mounting holes of the mount points are defined in an underside of the engine block adapter.

In an additional aspect, an engine block adapter is disposed inside the cowling below the power head and rigidly connected to the power head. An exhaust housing is disposed below the engine adapter block and rigidly connected to the engine adapter block. The mount points are disposed on the exhaust housing.

In an additional aspect, an engine block adapter is disposed inside the cowling below the power head and rigidly connected to the engine adapter block. A driveshaft housing is disposed below engine adapter block and rigidly connected to the engine adapter block. The mount points are disposed on an upper part of the driveshaft housing.

In another aspect, an engine block adapter is disposed inside the cowling below the power head and rigidly connected thereto. An exhaust housing is disposed below the engine adapter block and rigidly connected thereto. A driveshaft housing is disposed below engine adapter block and rigidly connected thereto. The mount points are disposed on at least one of the exhaust housing, the driveshaft housing and the underside of the engine block adapter.

In a further aspect, an engine block adapter is disposed inside the cowling below the power head and rigidly connected thereto. The plurality of mount points is five mount points disposed on the underside of the engine block adapter.

In a further aspect, the plurality of mount points includes at least two mount points disposed in a horizontal plane.

In another aspect, the visual indication is on an inner surface of the at least one rear panel.

In yet another aspect, the visual indication on the at least one rear panel comprises a first area having a different color than a second area of the at least one rear panel adjacent to the first area.

In another aspect, the at least one rear panel comprises a break-away section defining the visual indication.

In an additional aspect, the area to be removed of the at least one rear panel has a thickness less than a thickness of the at least one panel adjacent to the area to be removed.

In a further aspect, the visual indication is aligned with the tilt/trim axis.

In a further aspect, the visual indication is laterally aligned with the mount points.

In another aspect, the visual indication is disposed below the mount points in the vertical direction.

In an additional aspect, an idle relief muffler is in proximity to the at least one rear panel of the cowling and the visual indication on the at least one rear panel is vertically below the idle relief muffler.

In a further aspect, the marine outboard engine has a sealing element extending around the engine.

In an additional aspect, a sealing element disposed is in proximity to the cowling near the visual indication. The sealing element has a sealing element opening adapted for receiving therethrough the tie-bar bracket mounted on and extending from the mount points.

In another aspect, the present provides a marine outboard engine including a cowling having at least one rear panel at a rear end of the cowling. The at least one rear panel defines an opening therethrough. A power head is disposed inside the cowling. A driveshaft housing is disposed at least in part inside the cowling below the power head. A driveshaft is disposed in the driveshaft housing. An exhaust housing is disposed at least in part inside the cowling below the power head. An engine block adapter is disposed below the power head and rigidly fixed thereto. The driveshaft housing and the exhaust housing are disposed below the engine block adapter and rigidly connected thereto. A plurality of mount points are disposed inside the cowling. Each mount point is rigidly connected to the power head and has a bracket-mounting hole defined therein. The bracket-mounting holes are disposed in at least one of the power head, the engine adapter block, the exhaust housing and the driveshaft housing. The marine outboard engine also includes a tie-bar bracket having a mounting portion at a first end and a tie-bar coupling portion at a second end opposite the first end. The mounting portion of the tie-bar bracket has tie-bar holes formed therein. The tie-bar holes coincide with the bracket-mounting holes of the mount points. The tie-bar bracket is mounted to the mount points by a threaded fastener received in the tie-bar and coinciding bracket-mounting holes. The tie-bar bracket extends through the opening in the at least one rear panel and the tie-bar coupling portion extends outside the cowling rearward of the cowling. For each coinciding bracket-mounting hole and tie-bar hole, at least one of the bracket-mounting hole and the tie-bar hole being a through-hole.

In another aspect, the mounting portion of the tie-bar bracket extends generally parallel to the driveshaft.

In a further aspect, the mounting portion of the tie-bar bracket has a dimension in a lateral direction parallel to a tilt/trim axis of the marine outboard engine greater than a dimension in the lateral direction of a portion of the tie-bar bracket adjacent to the mounting portion.

In an additional aspect, the mounting portion of the tie-bar bracket extends generally parallel to the driveshaft.

In a further aspect, the mount points are disposed on the engine block adapter. The bracket-mounting holes of the mount points are defined in an underside of the engine block adapter.

In another aspect, an idle relief muffler is disposed between the mount points and the at least one rear panel of the cowling, and wherein the opening in the rear panel is disposed below the idle relief muffler.

In yet another aspect, a sealing element surrounds the tie-bar bracket at least at a position adjacent to the opening in the rear panel thereby sealing the opening in the rear panel.

In a further aspect, a sealing element surrounds the tie-bar bracket and extends around the engine.

In an additional aspect, a grommet is fitted into the opening in the at least one rear panel.

In an additional aspect, the bracket-mounting holes are threaded holes and the tie-bar holes are unthreaded through-holes.

In a further aspect, the bracket-mounting holes are unthreaded through-holes and the tie-bar holes are threaded holes.

In yet another aspect, the bracket-mounting holes and the tie-bar holes are unthreaded through-holes.

In another aspect, the present provides a method of assembling a tie-bar bracket in a marine outboard engine. The marine outboard engine has a cowling having at least one rear panel at a rear end of the cowling, a power head disposed inside the cowling, and a plurality of mount points disposed inside the cowling. Each mount point is rigidly connected to the power head and has formed therein a bracket-mounting hole. The at least one rear panel has defined therein a visual indication of an area to be removed to create an opening adapted for receiving therethrough a tie-bar bracket mounted on and extending from the mount points. The method comprises removing the at least one rear panel from the cowling and inserting the tie-bar bracket inside the cowling. The tie-bar bracket comprises a mounting portion and a tie-bar coupling portion opposite the mounting portion. The mounting portion has formed therein tie-bar holes corresponding with the bracket-mounting holes of the mount points. The method also comprises aligning the tie-bar holes of the tie-bar bracket with the bracket-mounting holes of the mount points, fastening the tie-bar bracket by inserting threaded fasteners into the tie-bar holes and the corresponding bracket-mounting holes of the mount points and creating an opening in the at least one rear panel at the location having the visual indication. The opening in the at least one rear panel is sized and shaped to receive therethrough the coupling portion of a tie-bar bracket. The method additionally comprises inserting the tie-bar coupling portion through the opening and mounting the at least one rear panel on the cowling.

In another aspect, the method further comprises installing a sealing element around the tie-bar bracket.

In yet another aspect, the method further comprises installing a grommet into the opening created in the at least one rear panel.

For purposes of the present application, terms related to spatial orientation when referring to a marine outboard engine and components in relation to the marine outboard engine, such as "forwardly", "rearwardly", "left", "right", "above" and "below", are as they would be understood by a driver of a boat to which the marine outboard engine is connected, with the marine outboard engine connected to the stern of the boat, in a straight ahead orientation (i.e. not steered left or right), and in an upright position (i.e. not tilted and not trimmed). The explanations provided above regarding the above terms take precedence over explanations of these terms that may be found in any one of the documents incorporated herein by reference.

Embodiments of the present invention each have at least one of the above-mentioned object and/or aspects, but do not necessarily have all of them. It should be understood that some aspects of the present invention that have resulted from attempting to attain the above-mentioned object may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

Figure 1:
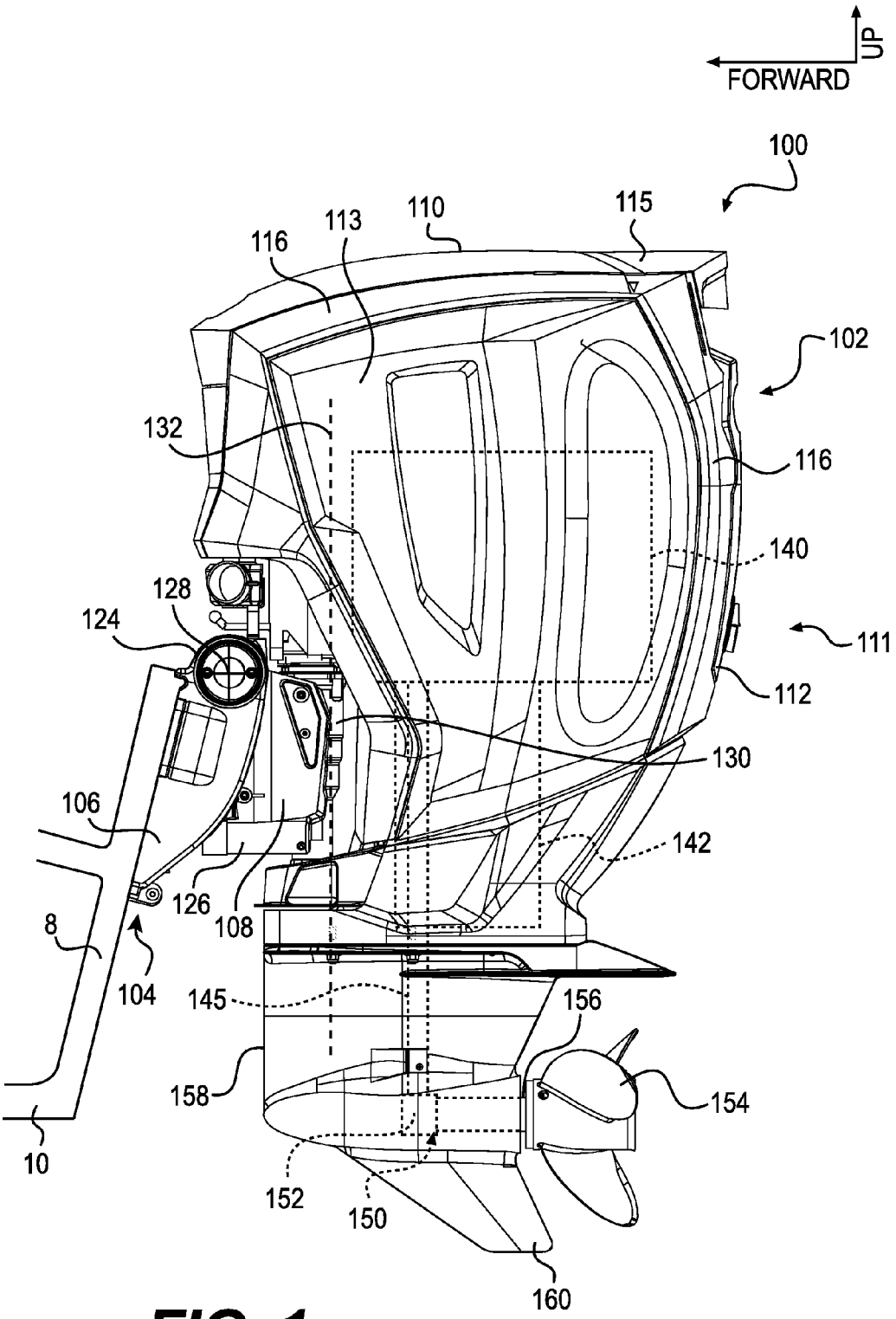
FIG. 1 is a left side elevation view of a marine outboard engine mounted to a stern of a boat.

With reference to FIG. 1, a marine outboard engine 100, shown in the upright position, includes a drive unit 102 and a bracket assembly 104. The bracket assembly 104 supports and mounts the drive unit 102 to a transom 8 of a hull 10 of a watercraft (not shown). The drive unit 102 has a cowling 110 enclosing a power head 140 (shown schematically) comprising an engine and other components such as injectors, starter motor, throttle and the like attached to the engine. The engine (not shown) is an internal combustion engine, such as a two-stroke or four-stroke engine, having cylinders extending generally horizontally when the drive unit 102 is in an upright position as shown. It is contemplated that other types of engines could be used and that the cylinders could be oriented differently.

Figure 5:
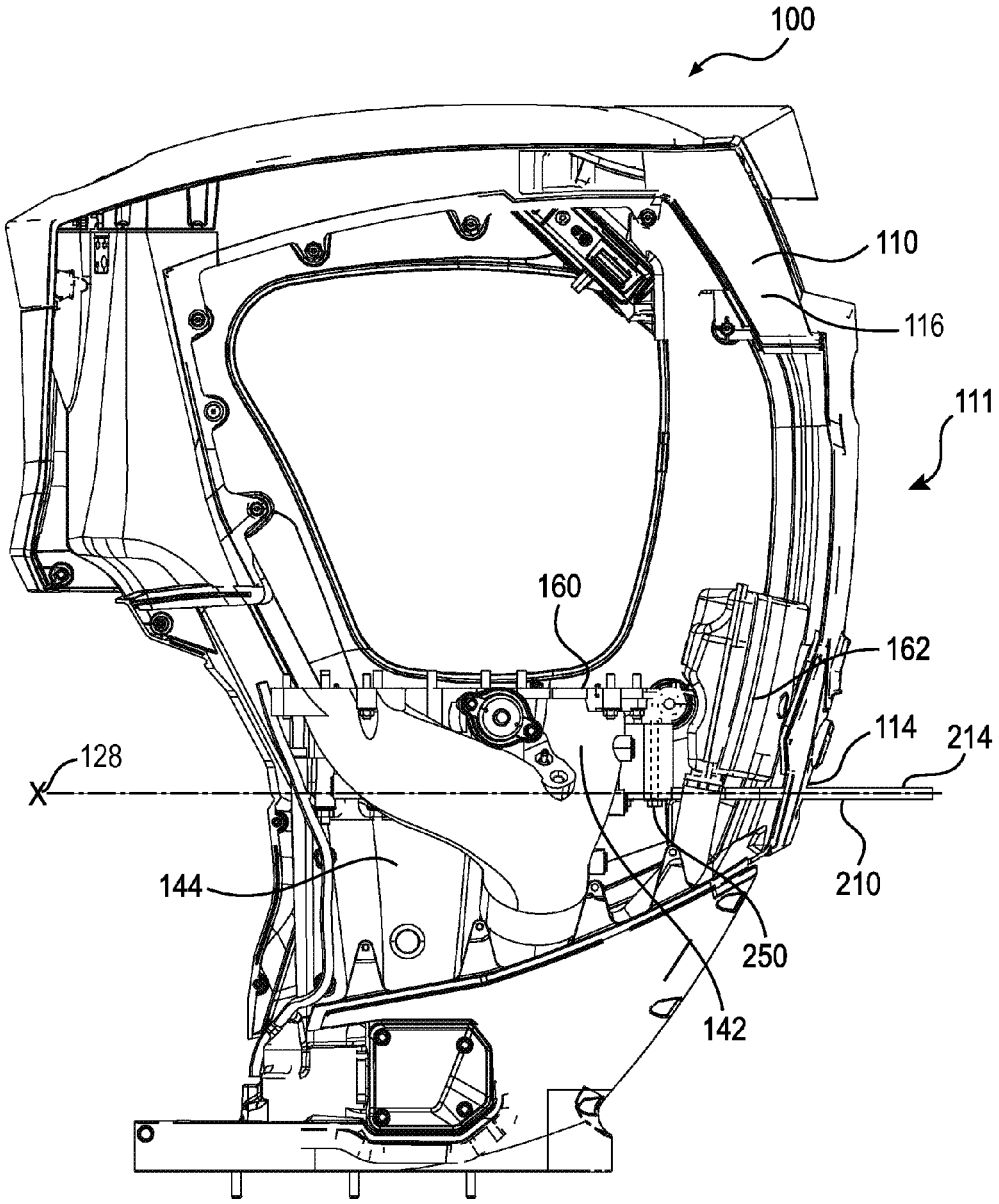
FIG. 5 is a side view of the upper portion of the marine outboard engine of FIG. 1 with the power head removed and a portion of the left side of the cowling removed showing the tie-bar bracket installed inside the cowling and projecting out from the rear end of the cowling.
Figure 6:
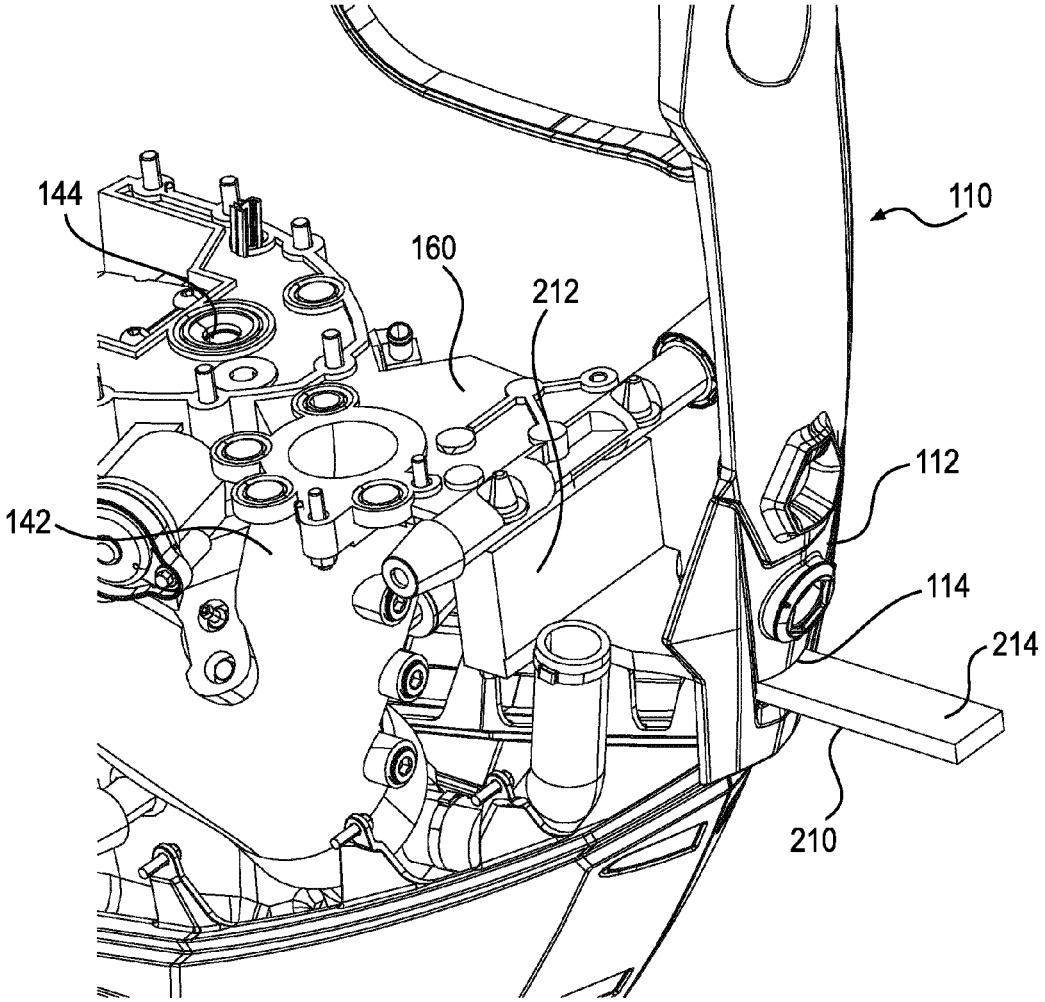
FIG. 6 is a perspective view taken from the rear, left side of a portion of the upper portion of the marine outboard engine of FIG. 1 with the power head and a portion of the left side of the cowling removed and showing the tie-bar bracket installed inside the cowling and projecting out from the rear end of the cowling.

The engine is coupled to a vertically oriented driveshaft 145 (shown schematically) housed in a driveshaft housing 144 (FIG. 6). The power head 140 is also connected to an exhaust system housed in an exhaust housing 142 (shown schematically). The upper portion of the exhaust housing 142 is enclosed in the cowling 110. An engine block adapter 160 (FIG. 5) is rigidly bolted to the power head 140 between the power head 140 and the exhaust housing 142 and the driveshaft housing 144. The driveshaft housing 144 and the exhaust housing 142 are rigidly fixed to the engine block adapter.

The driveshaft 145 is coupled to a drive mechanism 150 (shown schematically), which includes a transmission 152 (shown schematically) and a bladed rotor, such as a propeller 154 mounted on a propeller shaft 156. The propeller shaft 156 is generally perpendicular to the driveshaft 145, but could be at other angles. The drive mechanism 150 could also include a jet propulsion device, turbine or other known propelling device. The bladed rotor 154 could also be an impeller.

The cowling 110 is formed of an assembly of panels 115 and a central support structure 116. The central support structure 116 is fixedly connected to the engine via rubber mounts to damp the vibrations of the engine. Several panels 115 are removably connected to the central support structure 116. The panels 115 may be friction-fitted, hinged, or attached to each other and to the central support structure by fasteners. The panels 115 form an outer surface of the cowling 110 and the central support structure 116 supports the panels 115 and connects them to the engine. The panels 115 could be made of plastic, metal or of composite material.

The bracket assembly 104 includes a stern bracket 106 and a swivel bracket 108. The stern bracket 106 mounts the outboard engine to the transom 8 of a watercraft and is pivotally connected to the swivel bracket 106 via a rotary actuator 124. The swivel bracket 108 is connected to the cowling 110 via drive unit mounts comprising resilient vibration isolation elements. The swivel bracket 108 partly houses a steering shaft (not shown) of the marine outboard engine 100.

The bracket assembly 104 supports the drive unit 102 on the transom 8 such that a propeller 154 is in a submerged position with the watercraft resting relative to a surface of a body of water. The drive unit 102 can be trimmed up or down relative to the hull 10 by linear actuators 126 of the bracket assembly 104 about a tilt/trim axis 128 extending generally horizontally. The drive unit 102 can also be tilted up or down relative to the hull 10 by a rotary actuator 124 of the bracket assembly 104 about the tilt/trim axis 128. The drive unit 102 can also be steered left or right relative to the hull 10 by a rotary actuator 130 of the bracket assembly 104 about a steering axis 130. The steering axis 132 extends generally perpendicularly to the tilt/trim axis 128. When the drive unit 102 is in the upright position as shown in FIG. 1, the steering axis 132 extends generally vertically. The actuators 124, 126 and 130 are hydraulic actuators. The central shaft of the rotary actuator 124 is coaxial with the tilt/trim axis 128. The stern bracket 120 and the central shaft are all rotationally fixed relative to each other. The central shaft of the rotary actuator 130 is coaxial with the steering axis 132.

U.S. Pat. No. 7,736,206 B1, issued Jun. 15, 2010, the entirety of which is incorporated herein by reference, provides additional details regarding rotary actuators similar in construction to the rotary actuators 124 and 130. It is contemplated that the rotary actuator 124 could be replaced by a linear hydraulic actuator connected between the swivel bracket 108 and the stern bracket 106. It is contemplated that the rotary actuator 130 could be replaced by a linear hydraulic actuator connected between the swivel bracket 122 and the drive unit 102. It is also contemplated that a rear bracket could be mounted in the rear of the outboard engine 100 and a steering actuator could be mounted longitudinally along the sides of the outboard engine 100, extending rearward from the stern bracket 106 to the rear bracket. It is also contemplated that the rear bracket, and thereby the steering mechanism, could be fixed to the power head 140 inside the cowling 110.

Figure 2:
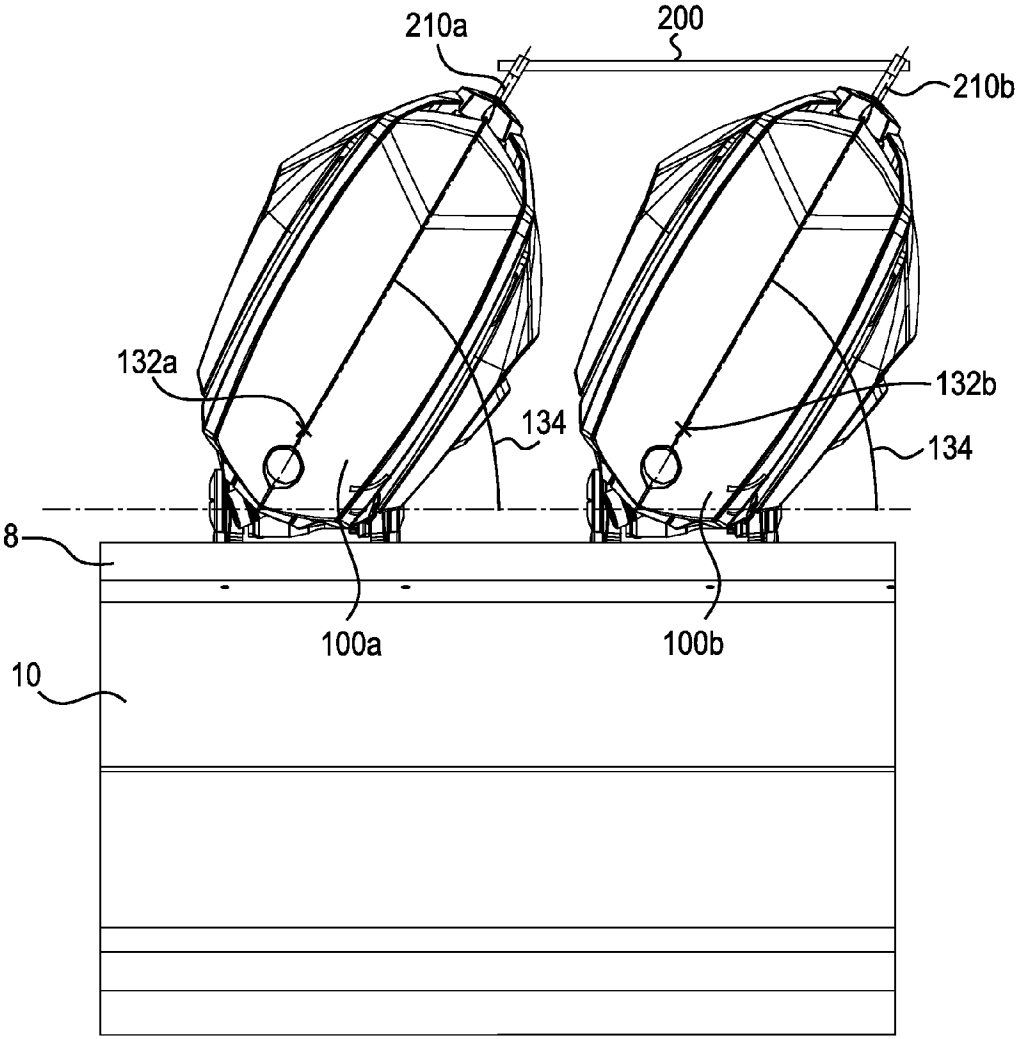
FIG. 2 is a top view of two marine outboard engines mounted to a stern of a boat and joined together with a tie-bar, with the marine outboard engines steered to make the boat turn left.

FIG. 2 shows a top view of two outboard engines 100*a* and 100*b* mounted on a transom 8 of a hull 10 connected together at the rear by a tie-bar 200. The tie-bar 200 synchronizes the steering of the outboard engines 100*a,b*. The tie-bar 200 is pivotally connected to tie-bar brackets 210*a,b* at the rear of the outboard engines 100*a,b* at a distance from the steering axis 132*a,b* so that a turning of one of the outboard engines 100*a,b* by an angle 134 results in a turning of the other of the outboard engines 100*a,b* by an equal angle 134. The marine outboard engines 100*a,b* have the same construction as the outboard engine 100 described above and in more detail below. It is contemplated that only one of the outboard engines 100*a,b* is provided with an actuator 130. The tie-bar brackets have the same construction as the tie-bar brackets 210 described below.

Figure 3:
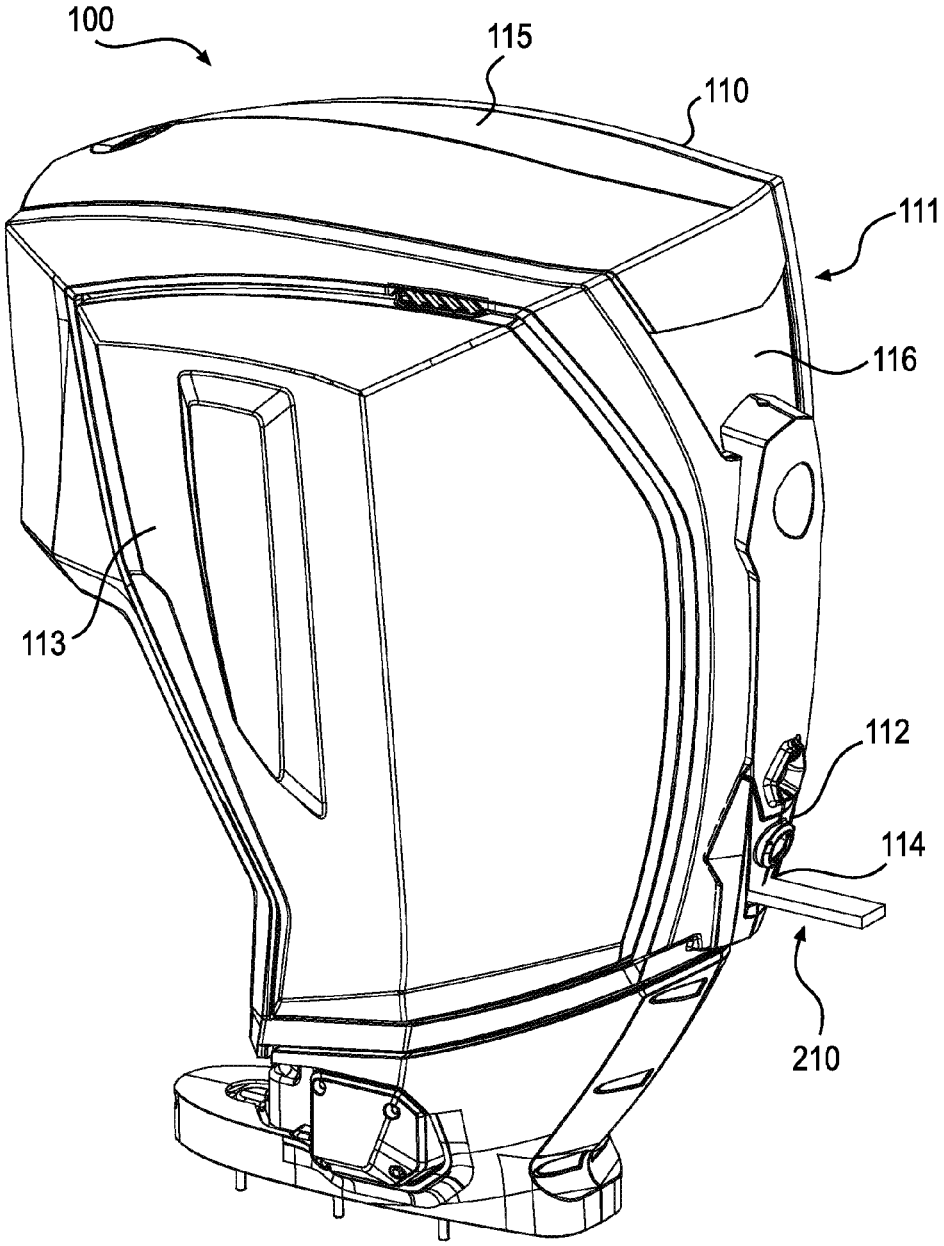
FIG. 3 is a perspective view taken from a rear left side of an upper portion of the marine outboard engine of FIG. 1 having a tie-bar bracket installed in the cowling and projecting out from a rear end of the cowling.
Figure 4:
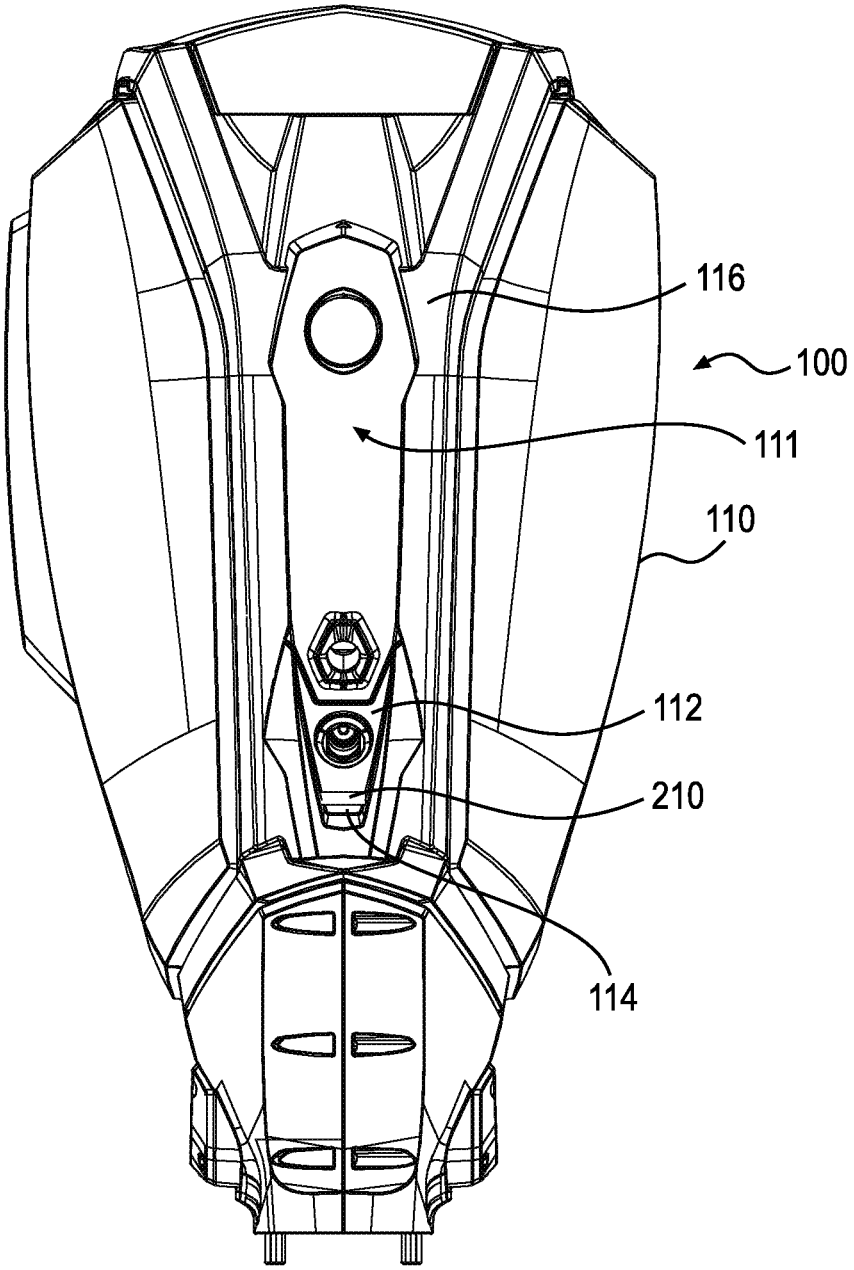
FIG. 4 is a rear elevation view of the upper portion of the marine outboard engine of FIG. 1 showing the tie-bar bracket installed in the cowling and projecting out from the rear end of the cowling.

FIGS. 3 and 4 show the marine outboard engine 100 with a tie-bar bracket 210 installed. The tie-bar bracket 210 is attached inside the cowling 110 and extends out of the cowling from an opening 114 in a rear panel 112 at the rear end 111 of the cowling 110. The tie-bar 200 is to be pivotally coupled to the portion of the tie-bar bracket 210 extending out of the cowling 110.

As can be seen in FIG. 5 the driveshaft housing 144 and the exhaust housing 142 are disposed below the engine block adapter 160 and rigidly attached thereto. An idle relief muffler 162 is disposed in proximity to the rear panel 112 at the rear end 111 of the cowling 110. The idle relief muffler 162 is disposed between the engine block adapter 160 and the rear panel 112 of the cowling 110. The tie-bar bracket 210 is mounted to the underside of the engine block adapter 160, extends rearward below the idle relief muffler 162 and outside of the cowling 110 through the opening 114 in the rear panel 112. The tie-bar bracket 210 is rigidly attached to the engine adapter block 160 by threaded fasteners 250. The longitudinal axis of the tie-bar bracket 210, as can be seen in FIG. 5, is aligned with the tilt/trim axis 128.

Figure 7:
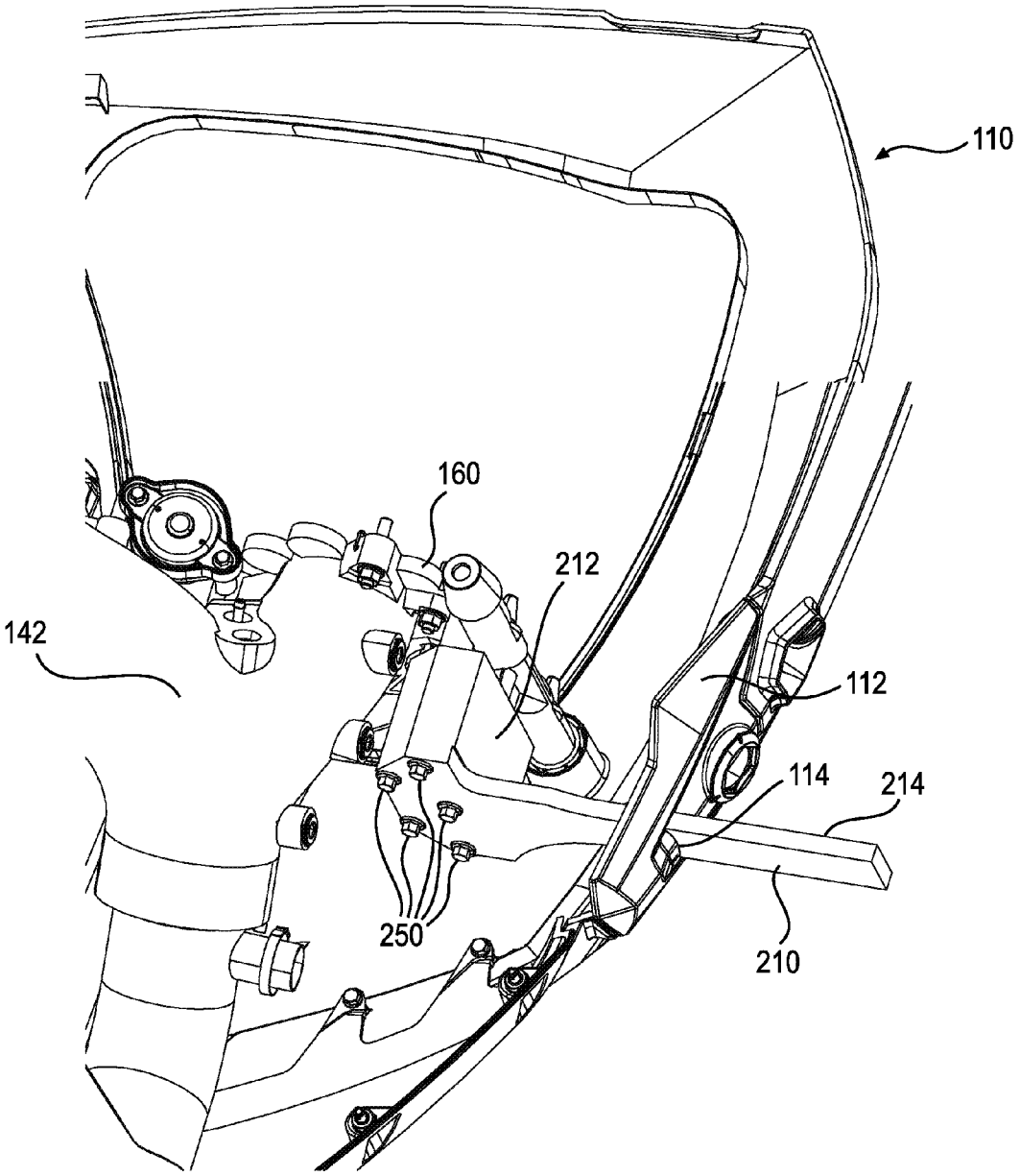
FIG. 7 is a close-up bottom perspective view taken from the rear, left side of the marine outboard engine of FIG. 1 showing the tie-bar bracket installed inside the cowling and projecting out from the rear end of the cowling and with the power head removed.
Figure 8:
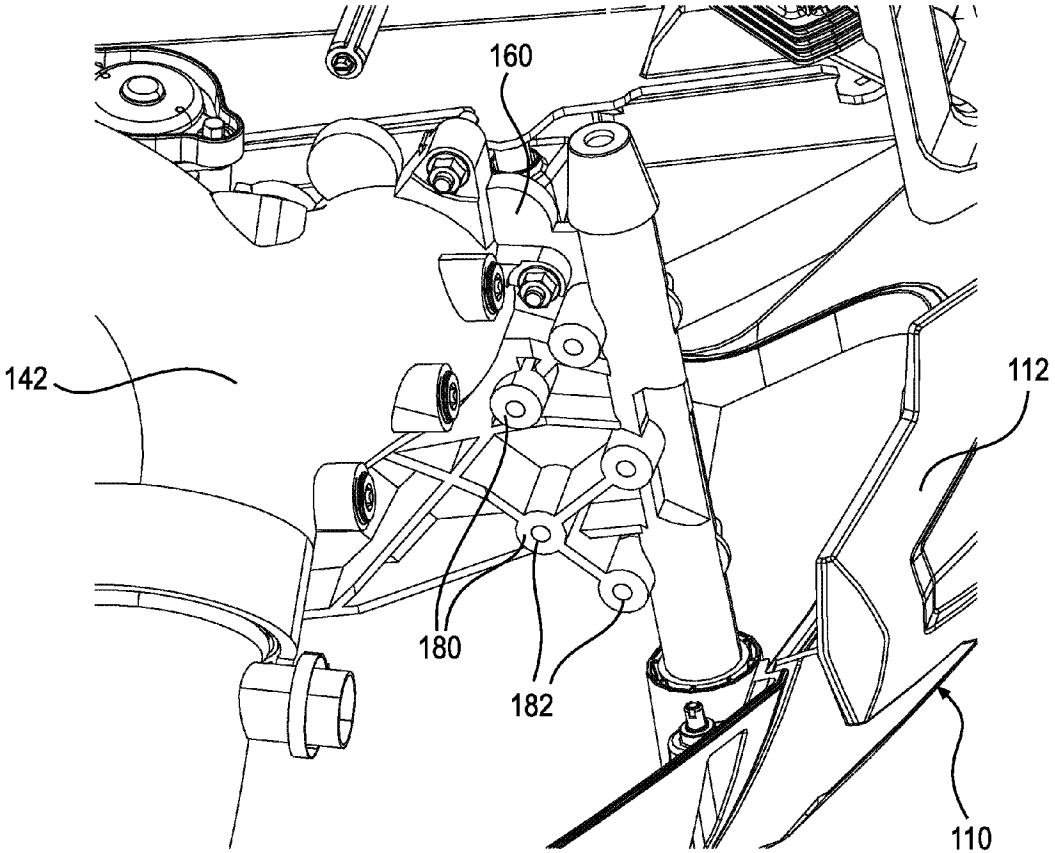
FIG. 8 is a close-up bottom perspective view taken from the rear, left side of the marine outboard engine of FIG. 1 with the power head and the tie-bar bracket removed and showing a plurality of mount points inside the cowling.

As can be seen in FIG. 8, the underside of the engine adapter block 160 has five mount points 180, each with a bracket-mounting hole 182. As can be seen in FIGS. 6 and 7, the tie-bar bracket 210 is rigidly attached to the engine adapter block 160 with five threaded fasteners 250. It is contemplated that there can be more or less than five mount points 180 and bracket-mounting holes 182.

Figure 9A:
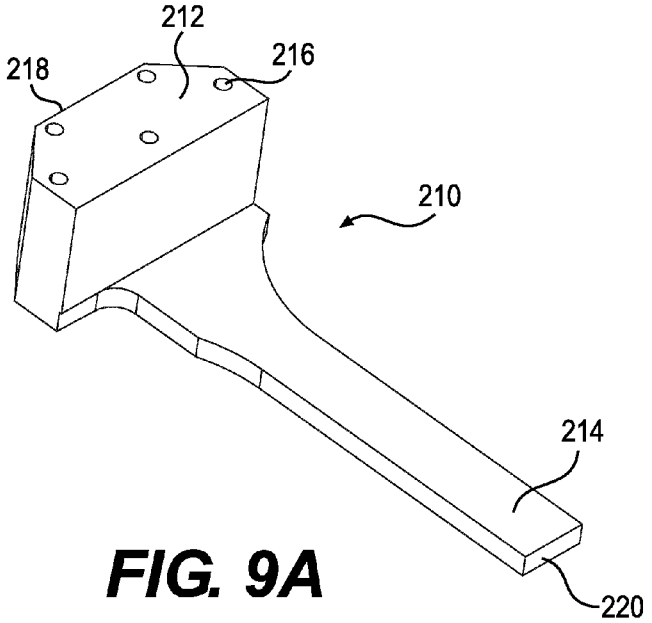
FIGS. 9A, 9B and 9C are respectively a perspective view taken from a rear, left side, a bottom plan view, and a right side elevation view of the tie-bar bracket of FIGS. 5 to 8, shown in isolation.
Figure 9B:
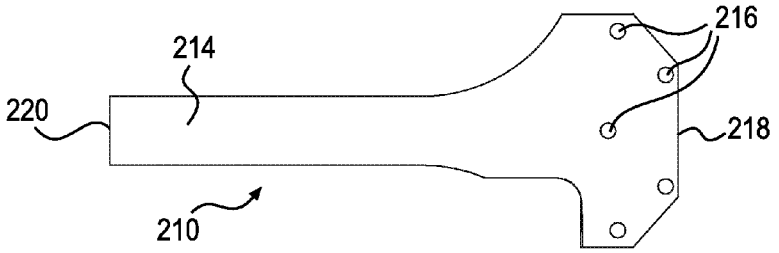
Figure 9C:
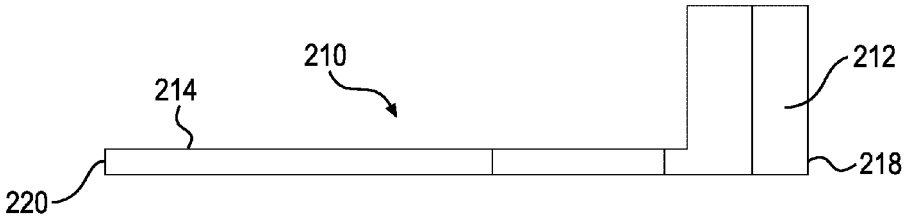

Turning now to FIGS. 9A, 9B and 9C, the tie-bar bracket 210 will be described. The tie-bar bracket 210 has a mounting portion 212 at a first end 218 and a tie-bar coupling portion 214 at a second end 220 opposite the first end 218. The coupling portion 214 extends out of the cowling 110 and is pivotally coupled to the tie-bar 200 for joining together the two outboard engines 100 at its opposite ends. The coupling portion 214 may be provided with any suitable means for forming the pivotable connection with the tie-bar 200, for example, the coupling portion may be provided with a hole to receive a fastener therethrough. The mounting portion 212 of the tie-bar bracket 210 is mounted to the mount points 180 and has formed therein a plurality of tie-bar bracket holes 216. The tie-bar bracket holes 216 are arranged to correspond to the bracket-mounting holes 182 in the mount points 180 of the engine adapter block 160, and the tie-bar bracket 210 is configured to align and mate the bracket-mounting holes 182 of the mount points 180 with the tie-bar bracket holes 216. Accordingly, the tie-bar bracket 210 generally extends in a horizontal direction between the first 218 and second ends 220 and the mounting portion 212 extends perpendicularly thereto in a vertical direction at the first end 218. The mounting portion 212 also has a lateral dimension that is greater than the lateral dimension of the tie-bar bracket 210 away from the mounting portion 212, for example, near the coupling portion 214. This lateral extent allows the tie-bar bracket 210 to be mounted to all five of the bracket-mounting holes 182 in the engine adapter block 160. It is however contemplated that the tie-bar bracket 210 can have a mounting portion 212 of any shape and size that permits it to be mounted to at least two mount points 180.

In the embodiment shown in the figures, the tie-bar bracket holes 216 are unthreaded through-holes and the bracket-mounting holes 182 in the underside of the engine block adapter 160 are threaded holes. The tie-bar bracket 210 is rigidly attached to the engine block adapter 160 by passing a threaded fastener 250 into each tie-bar bracket holes 216 of the mounting portion 212 through the mounting portion 212 and into the corresponding threaded bracket-mounting holes 182 of the engine block adapter 160. It is however contemplated that the bracket mounting holes 182 in the engine block adapter 160 could be through holes and tie-bracket holes 216 could be threaded and the fastener 250 could be inserted into the bracket mounting holes 182 through the engine block adapter 160 into the tie-bracket holes 216 to attach the tie-bar bracket 210 to the engine block adapter 160. It is also contemplated that both the tie-bar bracket holes 216 and the bracket-mounting holes 182 could be unthreaded through-holes and the tie-bar bracket 210 and the engine block adapter 160 could be rigidly attached with threaded fasteners and nuts.

It is contemplated that the tie-bar bracket 210 could be mounted in orientations different from the one shown in the figures. It is contemplated that the tie-bar bracket 210 could also be mounted to the upper surface of the engine block adapter 160 and pass above the idle relief muffler 162 to emerge from a higher opening 114 in the rear panel 112 of the cowling 110. The opening 114 would then be disposed at a location above the idle relief muffler 162. It is also contemplated that for an outboard engine having an idle relief muffler positioned elsewhere, the tie-bar bracket 210 could be substantially flat and extend neither upwards or downwards. The mount points 180 and the opening 114 are in horizontal alignment, however, it is contemplated that the mount points 180 and the opening 114 could be horizontally not aligned. The mount points 180 and opening 114 are shown to be in horizontal alignment with the driveshaft 145 and steering axis 132, however, they may be not be horizontally aligned with the steering axis 132 and the driveshaft 145. It is contemplated that the structure of the tie-bar bracket 210 could be adapted to take any appropriate path between the mount points 180 and the rear 111 of the cowling 110 considering obstructions and spatial limitations inside the cowling 110, and the opening 114 in the rear panel 112 could accordingly be defined at a location where the tie-bar bracket 210 would traverse the rear end 111 of the cowling 110.

As mentioned previously, the engine block adapter 160 is rigidly fixed to the power head 140 without any damping elements such as rubber pads and the like between them. The tie-bar bracket 210, rigidly fastened to the engine block adapter 160, is thus rigidly fixed to the power head 140. It is contemplated that the tie-bar bracket 210 could be rigidly fastened directly to the power head 140 by defining mount points 180 with bracket-mounting holes 182 in the power head 140. It is also contemplated that the bracket-mounting holes 182 could be formed in any other structure, such as the driveshaft housing 144 or the exhaust housing 142, for example, that is disposed within the cowling 110 and rigidly fixed to the power head 140. Mount points 180 having bracket-mounting holes 182 could also be defined on different structures rigidly fixed to the power head 140 thereby rigidly fixing the tie-bar bracket 210 to the power head 140 via different structures. The tie-bar bracket holes 216 would be appropriately adapted for the particular configuration of bracket-mounting holes 182. The structure of the tie-bar bracket 210 could also be adapted for a particular path between the mount points 180 and the opening 114 in the rear panel 112 of the cowling 110.

The bracket-mounting holes 182 are shown disposed in a single horizontal plane and accordingly the mounting portion 212 of the tie-bar bracket 210 has a flat surface, however, it contemplated that the bracket-mounting holes 182 could be disposed in a vertical plane or in multiple planes. The structure and mounting orientation of the tie-bar bracket 210 would be adapted accordingly.

Figure 10:
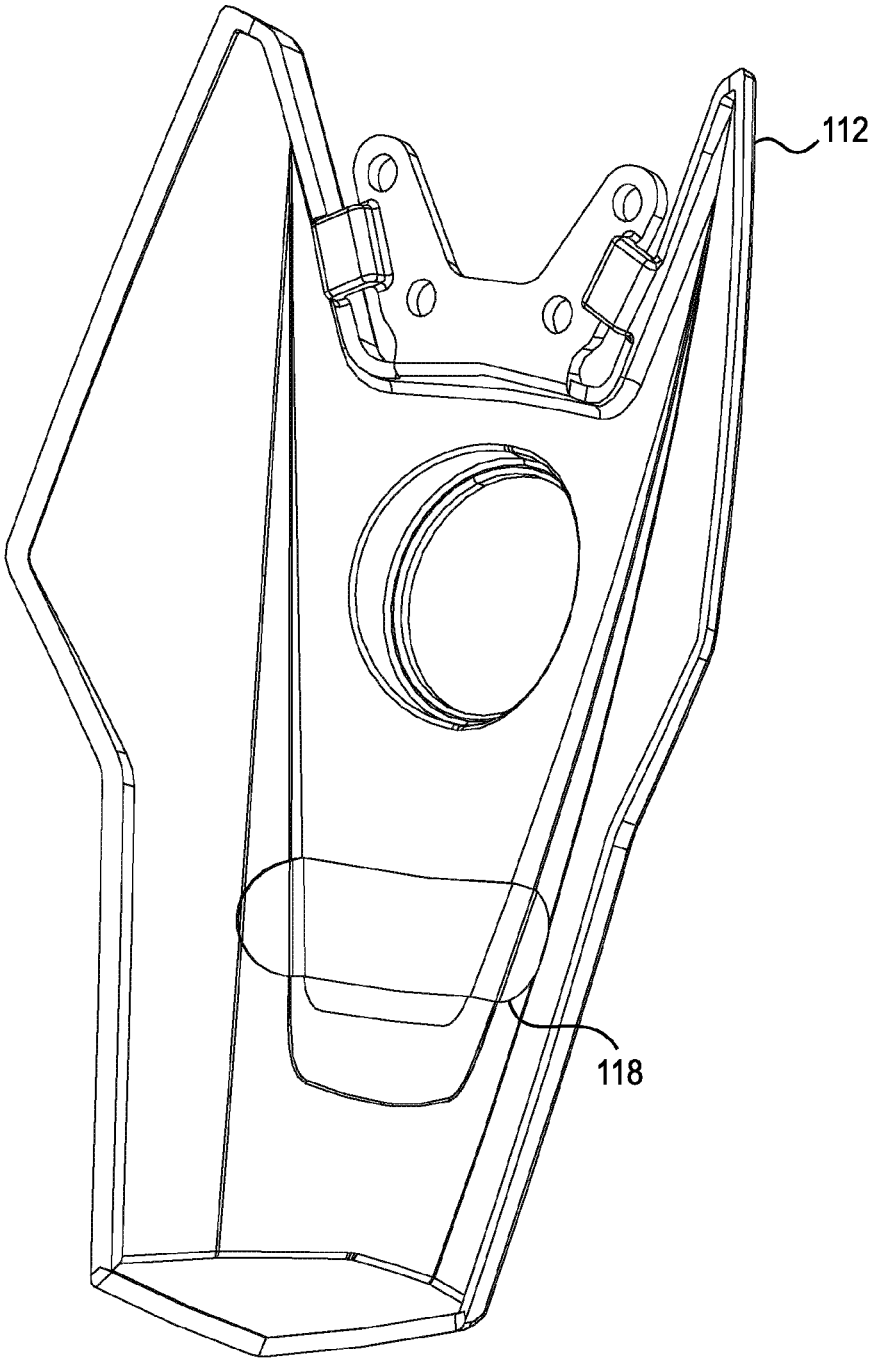
FIG. 10 is a perspective view taken from a front, left side of a rear panel of the cowling of the marine outboard engine of FIG. 1.

With reference to FIG. 10, the rear panel 112 of the cowling 110 is provided with a visual indication 118 of an area to be removed to create the opening 114 should the tie-bar bracket need to be installed. The visual indication 118 could be formed on the inside or the outside of the rear panel 112. The visual indication 118 could mark a center of the opening 114 or delineate the area to be removed. The area to be removed could be colored or outlined in a color distinct from the adjacent areas of the rear panel 112 to form the visual indication 118. The visual indication could similarly comprise a change in thickness of the rear panel 112 in the area covering or surrounding the area to be removed. The visual indication 118 could comprise a break-away portion such as an area enclosed within a perforated boundary or an area having a thickness less than the adjacent areas of the rear panel 112. The area to be removed can be punched out, pushed out, broken away, cut away or otherwise removed to cleanly and consistently create the opening 114. It is contemplated that the visual indication 118 could consist of a cap that could be inserted or removed from the opening 114 as necessary.

It is contemplated that the panels of the cowling 110 could be constructed such that there is more than one rear panel 112 and that the opening 114 could span multiple adjacent panels, or that the coupling portion 214 of the tie-bar bracket 210 could be formed with multiple distinct parts projecting out of the rear end 111 of the cowling 110 through multiple openings 114 formed in at least one rear panel 112. The visual indication 118 of the opening 114 could accordingly be formed on multiple rear panels 112.

As the panels 115 are removable from the central support structure 116, they can be shipped separately from the central support structure 116 and the engine. It is contemplated that a rear panel 112 having the opening 114 adapted for receiving a particular tie-bar bracket 210, or having the visual indication 118 for the opening 114 could be provided along with the tie-bar brackets 210 as part of a tie-bar assembly kit. The tie-bar assembly kit could also include the fasteners 250. Additionally, a tie-bar 200 could also be provided with the kit.

Figure 11:
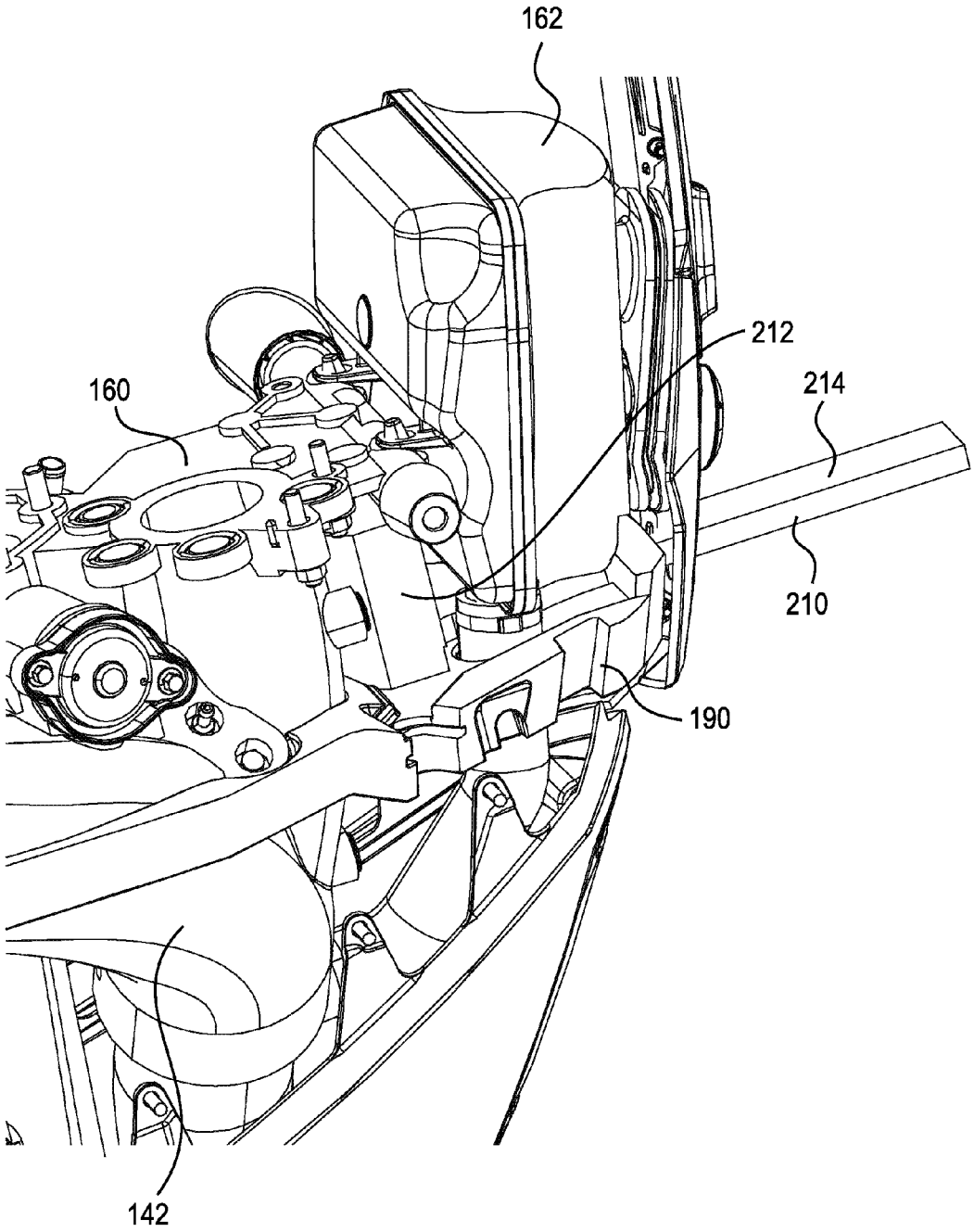
FIG. 11 is a perspective view taken from a front, left side of a portion of the interior of the cowling of the marine outboard engine of FIG. 1 showing a sealing element surrounding the internal structures of the cowling.
Figure 12:
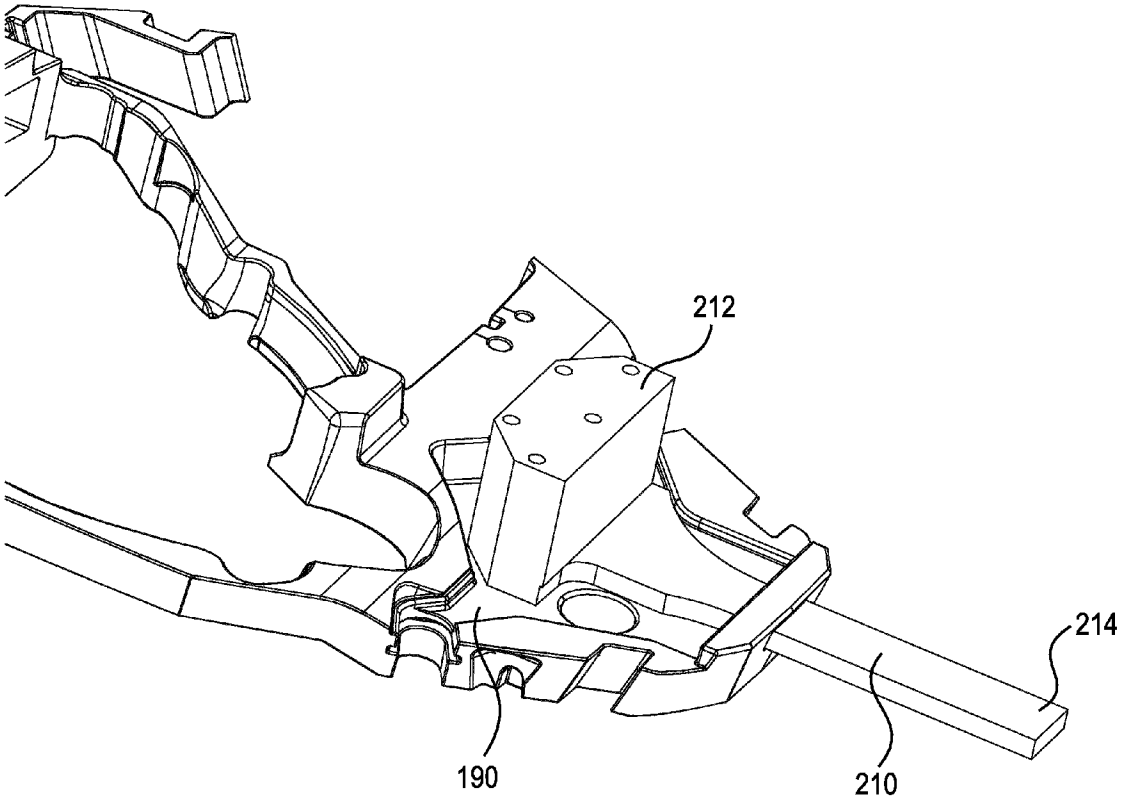
FIG. 12 is a perspective view taken from a front, left side of the sealing element and the tie-bar bracket of FIG. 11 in isolation.

As can be seen in FIG. 11 a sealing element 190 is inserted to surround the tie-bar bracket 210 and other structures inside the cowling 110. In the present embodiment, the sealing element 190 is made of foam and will be referred to as such for convenience hereinafter. The foam element 190 is custom molded to fit the internal structures of the cowling 110 and serves to seal, either alone or in combination with other components, the space in the cowling 110 enclosing the power head 140 and corresponding structures from the space below. The cowling 110 is additionally provided with two check valves (not shown) to drain out any fluid that may leak into the cowling 110.

Figure 13:
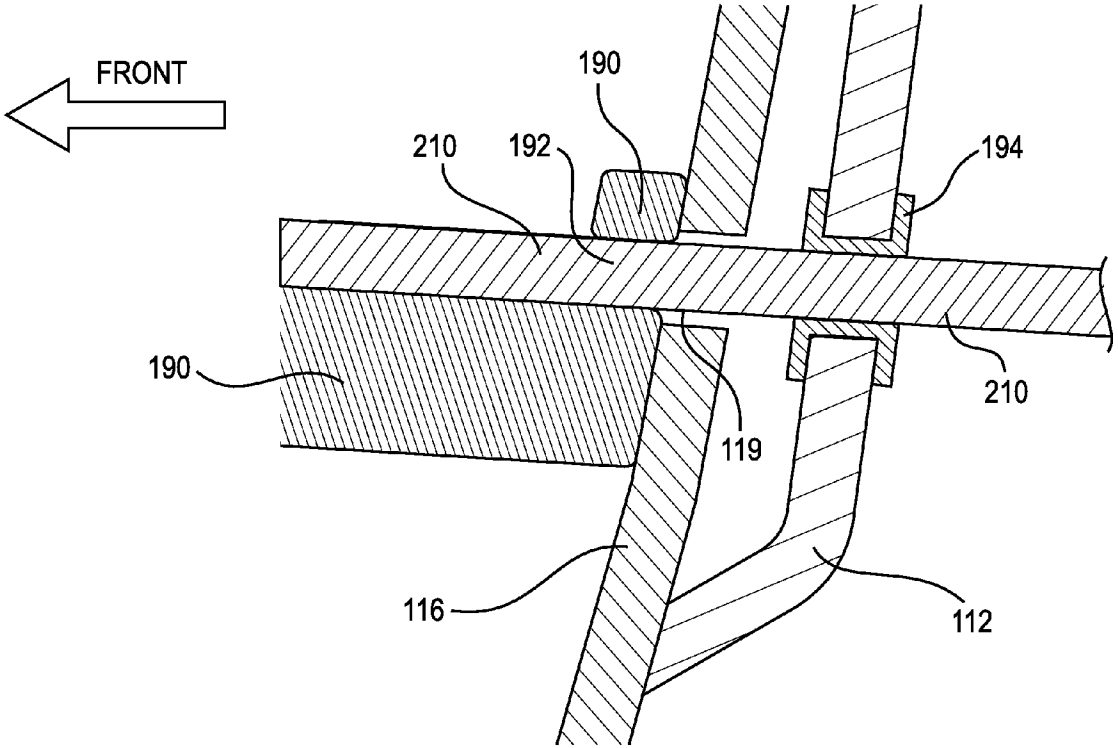
FIG. 13 is a vertical cross-section of portions of the sealing element, tie-bar bracket and cowling of FIG. 11 taken at the opening in the rear panel of the cowling.

The foam element 190 also helps to seal the opening 114 around the tie-bar bracket 210 as best seen in FIG. 13. The tie-bar bracket 210 passes through an opening 192 formed in the foam element 190 before passing out of the cowling 110 through an opening 119 in the central support structure 116 and the opening 114 in the rear panel 112. The foam element 190 tightly surrounds the tie-bar bracket 210 at the opening 192 and helps to prevent entry of water into the cowling 110 through the opening 114. A grommet 194 is also provided in the opening 114 in the rear panel 112 to smooth out any rough edges left from the creation of the opening 114 and to provide a tighter fit with the tie-bar bracket 210.

To mount the tie-bar bracket 210 to the outboard engine 100 as shown herein, a side panel 113 and a rear panel 112 are removed. An opening 114 is made in the rear panel 112 in the area marked by the visual indication 118. The grommet 194 is inserted in the opening 114. The tie-bar bracket 210 is then inserted into the cowling 110 and positioned to align the mounting portion 212 with the mount points 180, the tie-bar bracket 210 extending rearwards through the foam element 190 and the coupling portion 214 extending out of the rear end 111 of the cowling 110. The tie-bar bracket holes 216 are aligned with the bracket-mounting holes 182. The tie-bar bracket 210 is then rigidly fastened to the mount points 180 with the threaded fasteners 250 inserted into and through the tie-bar bracket holes 216 and into the bracket-mounting holes 182. The rear panel 112 of the cowling 110 having the opening 114 is then installed on the rear end 111 of the cowling 110 such that the coupling portion 214 is inserted though the opening 114 and extends out of the cowling 110. It will be appreciated that some or all of these steps can be performed in the reverse order to disassemble the tie-bar bracket 210 from the cowling 110.

It is contemplated that for certain configurations of mount points 180, tie-bar bracket 210 and opening 114, the tie-bar bracket 210 could be inserted into and installed inside the cowling 110 through an opening covered by a side panel 113 of the cowling 110 without removal of the rear panel 112. The tie-bar bracket 210, in this case, would be inserted through the opening 114 in the rear panel 112 before being fastened to the mount points 180. It is contemplated also that the tie-bar bracket 210 could be installed inside the cowling through the rear end 111 by removing the rear panel 112 without removal of any side panels 113 of the cowling 110.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A marine outboard engine configured for mounting a tie-bar bracket, the marine outboard engine comprising:

a cowling having at least one rear panel at a rear end of the cowling;

a power head disposed inside the cowling; and a plurality of rigid mount points disposed inside the cowling, each mount point being rigidly connected to the power head and having a bracket-mounting hole formed therein, the bracket-mounting hole being one of a threaded hole and an unthreaded through-hole, the at least one rear panel having defined thereon a visual indication of an area to be removed to create an opening, whereby when the area is removed to create the opening and the tie-bar bracket is mounted to the plurality of mount points, a portion of the tie-bar bracket extends through the opening.

2. The marine outboard engine of claim 1, further comprising an engine block adapter disposed inside the cowling below the power head and rigidly connected thereto; and wherein the mount points are disposed on the engine adapter block, the bracket-mounting holes of the mount points being defined in an underside of the engine block adapter.

3. The marine outboard engine of claim 1, further comprising:

an engine block adapter disposed inside the cowling below the power head and rigidly connected thereto;

an exhaust housing disposed below the engine adapter block and rigidly connected thereto; and a driveshaft housing disposed below engine adapter block and rigidly connected thereto;

wherein the mount points are disposed on at least one of the exhaust housing, the driveshaft housing and the underside of the engine block adapter.

4. The marine outboard engine of claim 1, further comprising an engine block adapter disposed inside the cowling below the power head and rigidly connected thereto;

wherein the plurality of mount points is five mount points disposed on the underside of the engine block adapter.

5. The marine outboard engine of claim 1, wherein the plurality of mount points includes at least two mount points disposed in a horizontal plane.

6. The marine outboard engine of claim 1, wherein the visual indication is on an inner surface of the at least one rear panel.

7. The marine outboard engine of claim 1, wherein the visual indication on the at least one rear panel comprises a first area having a different color than a second area of the at least one rear panel adjacent to the first area.

8. The marine outboard engine of claim 1, wherein the at least one rear panel comprises a break-away section defining the visual indication.

9. The marine outboard engine of claim 1, wherein the area to be removed of the at least one rear panel has a thickness less than a thickness of the at least one panel adjacent to the area to be removed.

10. The marine outboard engine of claim 1, wherein the visual indication is aligned with the tilt/trim axis.

11. The marine outboard engine of claim 1, wherein the visual indication is laterally aligned with the mount points.

12. The marine outboard engine of claim 1, wherein the visual indication is disposed below the mount points in the vertical direction.

13. The marine outboard engine of claim 1, further comprising an idle relief muffler in proximity to the at least one rear panel of the cowling and the visual indication on the at least one rear panel is vertically below the idle relief muffler.

14. The marine outboard engine of claim 1, further comprising a sealing element extending around the engine.

15. The marine outboard engine of claim 1, further comprising a sealing element disposed in proximity to the cowling near the visual indication and having a sealing element opening adapted for receiving therethrough the tie-bar bracket mounted on and extending from the mount points.

16. A marine outboard engine comprising:

a cowling having at least one rear panel at a rear end of the cowling, the at least one rear panel defining an opening therethrough;

a power head disposed inside the cowling;

a driveshaft housing disposed at least in part inside the cowling below the power head;

a driveshaft disposed in the driveshaft housing;

an exhaust housing disposed at least in part inside the cowling below the power head;

an engine block adapter disposed below the power head and rigidly fixed thereto, the driveshaft housing and the exhaust housing being disposed below the engine block adapter and rigidly connected thereto;

a plurality of mount points disposed inside the cowling, each mount point being rigidly connected to the power head and having a bracket-mounting hole defined therein, the bracket-mounting holes being disposed in at least one of the power head, the engine adapter block, the exhaust housing and the driveshaft housing; and a tie-bar bracket having a mounting portion at a first end and a tie-bar coupling portion at a second end opposite the first end, the mounting portion of the tie-bar bracket having tie-bar holes formed therein, the tie-bar holes coinciding with the bracket-mounting holes of the mount points, the tie-bar bracket being mounted to the mount points by a threaded fastener received in the tie-bar and coinciding bracket-mounting holes, the tie-bar bracket extending through the opening in the at least one rear panel, and the tie-bar coupling portion extending outside the cowling rearward of the cowling, for each coinciding bracket-mounting hole and tie-bar hole, at least one of the bracket-mounting hole and the tie-bar hole being a through-hole.

17. The marine outboard engine of claim 16, wherein the mounting portion of the tie-bar bracket extends generally parallel to the driveshaft.

18. The marine outboard engine of claim 16, wherein the mounting portion of the tie-bar bracket has a dimension in a lateral direction parallel to a tilt/trim axis of the marine outboard engine greater than a dimension in the lateral direction of a portion of the tie-bar bracket adjacent to the mounting portion.

19. The marine outboard engine of claim 18, wherein the mounting portion of the tie-bar bracket extends generally parallel to the driveshaft.

20. The marine outboard engine of claim 16, wherein the mount points are disposed on the engine block adapter, the bracket-mounting holes of the mount points being defined in an underside of the engine block adapter.

21. The marine outboard engine of claim 16, further comprising an idle relief muffler disposed between the mount points and the at least one rear panel of the cowling, and wherein the opening in the rear panel is disposed below the idle relief muffler.

22. The marine outboard engine of claim 16, further comprising a sealing element surrounding the tie-bar bracket at least at a position adjacent to the opening in the rear panel thereby sealing the opening in the rear panel.

23. The marine outboard engine of claim 16, further comprising a sealing element surrounding the tie-bar bracket and extending around the engine.

24. The marine outboard engine of claim 16, further comprising a grommet fitted into the opening in the at least one rear panel.

25. The marine outboard engine of claim 16, wherein the bracket-mounting holes are threaded holes and the tie-bar holes are unthreaded through-holes.

26. The marine outboard engine of claim 16, wherein the bracket-mounting holes are unthreaded through-holes and the tie-bar holes are threaded holes.

27. The marine outboard engine of claim 16, wherein the bracket-mounting holes and the tie-bar holes are through-holes.

28. A method of assembling a tie-bar bracket in a marine outboard engine, the marine outboard engine comprising:

a cowling having at least one rear panel at a rear end of the cowling;

a power head disposed inside the cowling; and a plurality of mount points disposed inside the cowling, each mount point being rigidly connected to the power head and having formed therein a bracket-mounting hole, the at least one rear panel having defined therein a visual indication of an area to be removed to create an opening adapted for receiving therethrough a tie-bar bracket mounted on and extending from the mount points;

the method comprising:

removing the at least one rear panel from the cowling;

inserting the tie-bar bracket inside the cowling, the tie-bar bracket comprising a mounting portion and a tie-bar coupling portion opposite the mounting portion, the mounting portion having formed therein tie-bar holes corresponding with the bracket-mounting holes of the mount points;

aligning the tie-bar holes of the tie-bar bracket with the bracket-mounting holes of the mount points;

fastening the tie-bar bracket by inserting threaded fasteners into the tie-bar holes and the corresponding bracket-mounting holes of the mount points;

creating an opening in the at least one rear panel at the location having the visual indication, the opening being sized and shaped to receive therethrough the coupling portion of a tie-bar bracket;

inserting the tie-bar coupling portion through the opening; and mounting the at least one rear panel on the cowling.

29. The method of claim 28, further comprising installing a sealing element around the tie-bar bracket.

30. The method of claim 28, further comprising installing a grommet into the opening created in the at least one rear panel.

* * * * *